US005793282A

United States Patent [19]

Arnold et al.

[11] Patent Number: 5,793,282

[45] Date of Patent: Aug. 11, 1998

[54] PIEZOELECTRIC AUDIO CHIME

[75] Inventors: Todd Lynn Arnold, Indianapolis; George Alan Burnett, Clayton, both of Ind.

[73] Assignee: Yosemite Investment, Inc., Indianapolis, Ind.

[21] Appl. No.: 432,399

[22] Filed: May 1, 1995

[51] Int. Cl.[6] ..... G08B 3/10

[52] U.S. Cl. ..... 340/384.6; 340/384.5; 340/384.7

[58] Field of Search ..... 340/384.5, 384.6, 340/384.7, 384.71, 384.72, 384.73, 392.4, 393.5, 474

[56] References Cited

U.S. PATENT DOCUMENTS

| | | | |
|---|---|---|---|
| 3,077,574 | 2/1963 | Marks | 340/384.6 |
| 4,139,842 | 2/1979 | Fujita et al. | 340/384.6 |
| 4,164,735 | 8/1979 | Salem | 340/384.6 |
| 4,213,121 | 7/1980 | Leam et al. | 340/384.6 |
| 4,215,339 | 7/1980 | Durkee | 340/384.7 |
| 4,250,496 | 2/1981 | Southgate | 340/384 E |
| 4,486,742 | 12/1984 | Kudo et al. | 340/384.6 |
| 4,792,789 | 12/1988 | Matrumoro | 340/384.71 |
| 4,833,454 | 5/1989 | Bawlik et al. | 340/384.71 |
| 5,315,288 | 5/1994 | Coward | 340/384.7 |
| 5,376,916 | 12/1994 | Ito | 340/384.6 |

OTHER PUBLICATIONS

Americans With Disabilities Act (ADA), Accessibility Guidelines For Buildings and Facilities, 4.10.13 Car Position Indicators, 56 Federal Register 144 (Jul. 26, 1991).

*Primary Examiner*—Jeffery A. Hofsass
*Assistant Examiner*—Ashok Mannava
*Attorney, Agent, or Firm*—Niro, Scavone, Haller & Niro

[57] ABSTRACT

An electronic chime is created by a piezoelectric transducer with an exponentially decaying audio signal. The electronic chime has a power supply, an oscillator, a drive circuit, and a piezoelectric transducer. The drive circuit contains reactive components that function with the piezoelectric transducer to modulate the amplitude of the decaying audio signal. The amplitude modulated audio signal better simulates a mechanical chime.

9 Claims, 6 Drawing Sheets

PIEZOELECTRIC AUDIO CHIME

BACKGROUND

The invention relates to a signaling means for producing an acoustic wave as a signaling indication. More specifically the invention uses an electronic circuit with a signal generator for generating an audio frequency and a piezoelectric transducer for converting the signal into audible sounds. The audible sound produced imitates a chime.

Generally, a chime tone may be characterized as having a maximum amplitude volume tone which decays while maintaining a near constant frequency. It is well known in the art to use a piezoelectric audio device to annunciate a chime tone upon the occurrence of a predetermined condition. Piezoelectric audio devices have the advantages of being rugged, reliable, small, and inexpensive. An example of a piezoelectric audio device that annunciates a chime tone upon the occurrence of a predetermined condition is disclosed in U.S. Pat. No. 4,213,121 issued to Learn et al. Referring to FIGS. 5A–B, an example of a piezoelectric audio device that produces a chime tone with a relatively smooth exponentially decaying amplitude at a near constant frequency is disclosed in U.S. Pat. No. 4,215,339 issued to Durkee.

Previous piezoelectric audio chime devices are considered by some as having a low quality sound because the tone of their sound is different from a mechanical chime. A mechanical chime is considered by some as having a high quality sound because a mechanical chime, such as produced by a bell, can suggest music. Referring to FIG. 6, one reason for the unique sound of a mechanical chime may be because a mechanical chime does not normally have a smooth exponentially decaying amplitude sound.

What is needed is a piezoelectric chime that sounds more like a mechanical chime yet still retains the advantages of a piezoelectric audio device.

SUMMARY

It is an object of the invention to produce a chime sound with a piezoelectric transducer that sounds like a mechanically produced chime.

It is still another object of the invention to produce a chime sound that is amplitude modulated to more realistically simulate a mechanical chime.

It is another object of the invention to produce a single shot chime with a simple, inexpensive electronic circuit.

DETAILED DESCRIPTION

Figure 1:
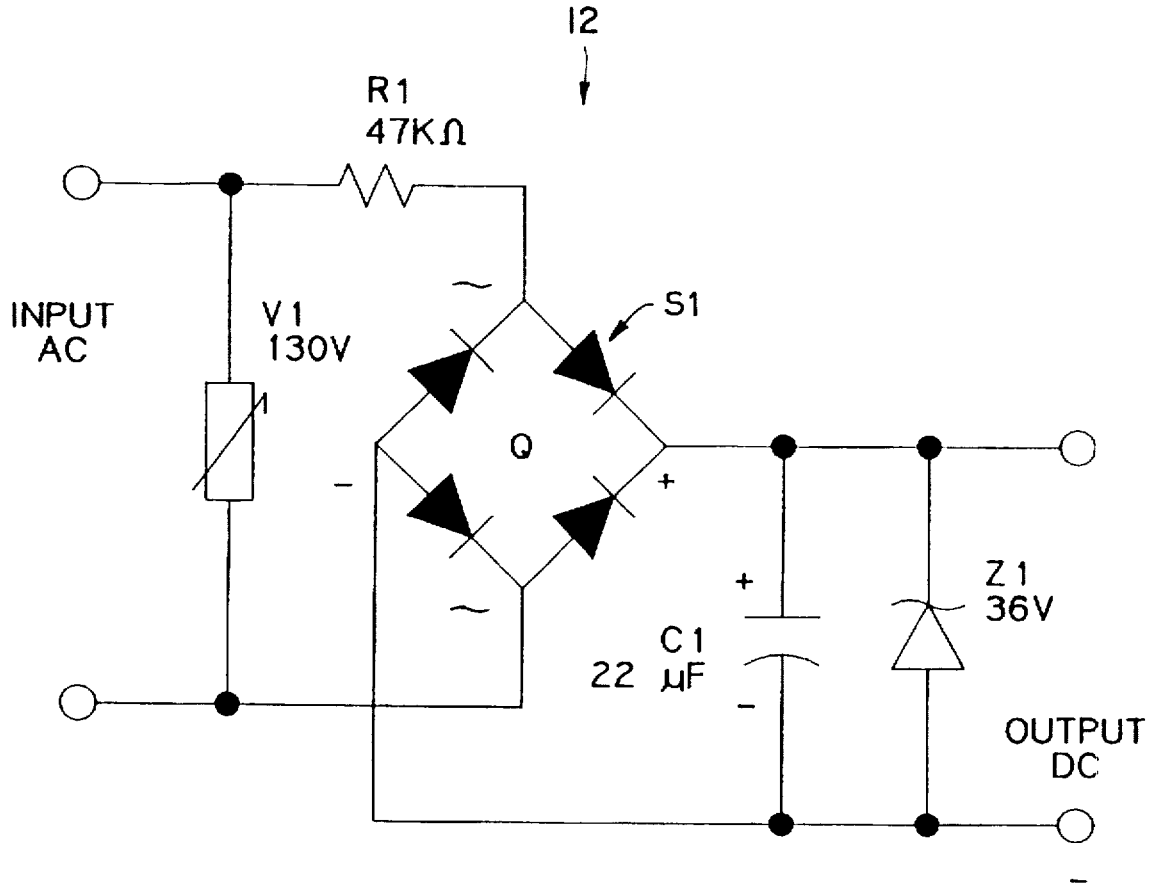
FIG. 1 shows a schematic diagram of a power supply.
Figure 2:
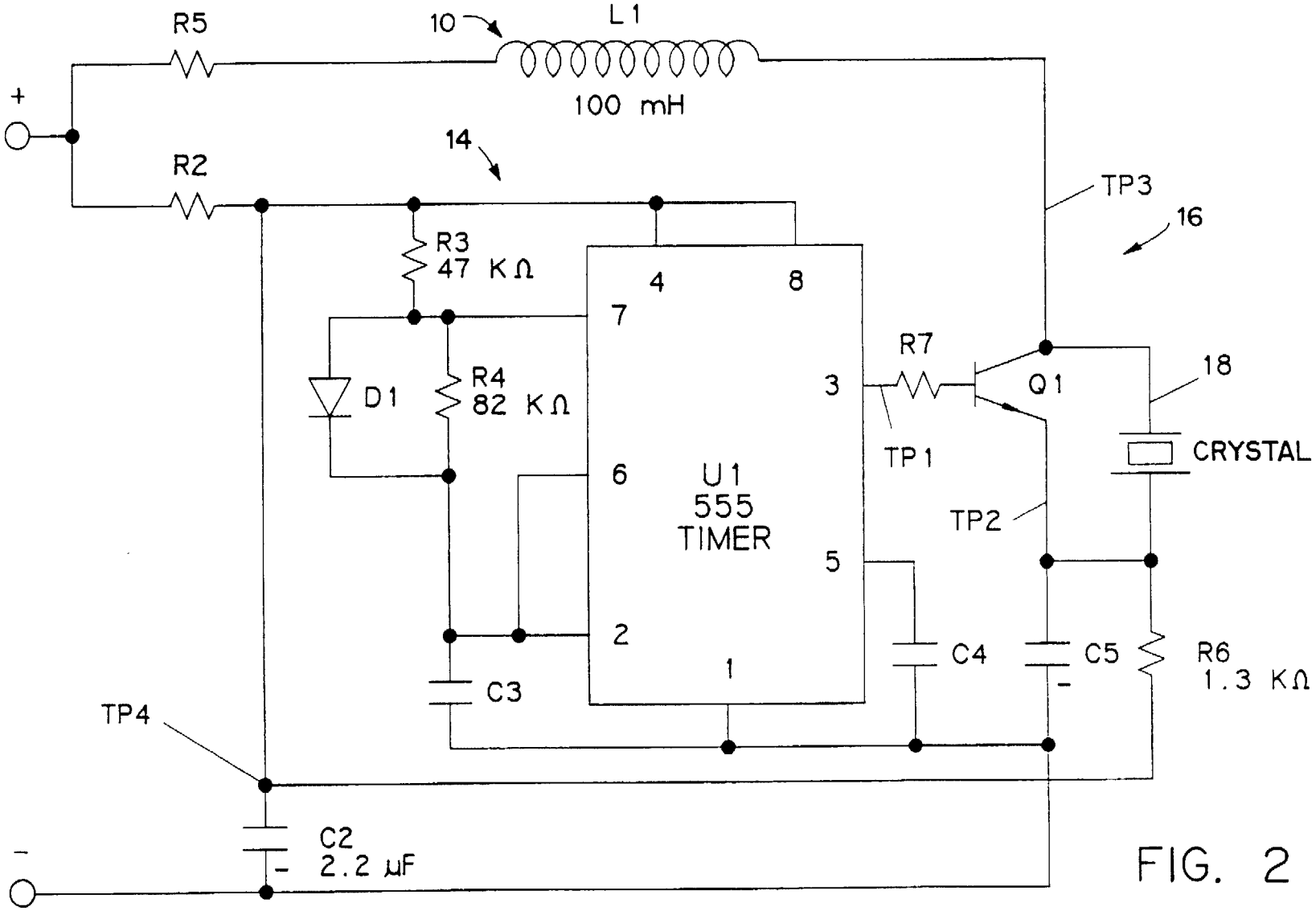
FIG. 2 shows a schematic diagram of the piezoelectric audio chime.

Referring to FIGS. 1–2, a piezoelectric audio chime 10 comprises a power supply 12, an oscillator 14, a drive circuit 16, and a piezoelectric transducer 18. Referring to FIG. 1, the power supply 12 is regulated to permit the piezoelectric audio chime 10 to operate from an AC voltage source of about 110 VAC. The power supply 12 produces a regulated output of about 36 VDC. The power supply 12 includes a silicon rectifier bridge S1, a Zener diode Z1, an electrolytic capacitor C1, a resistor R1, and a varistor V1. The piezoelectric audio chime 10 is typically activated by applying a source voltage to the power supply 12.

Referring to FIG. 2, the oscillator 14 comprises a timer U1 and a configuration circuit. The timer U1 produces a substantially square wave and is preferably an integrated circuit such as a 555 timer available from National Semiconductor® Corporation at 2900 Semiconductor Drive, P.O. Box 58090, Santa Clara, Calif. 95052-8090. The configuration circuit comprises a voltage divider of resistors R2 and R3, a frequency determining network of resistor R4, capacitor C3, diode D1, and a stabilizing capacitor C4. The frequency determining network values of resistor R4 and capacitor C3 are selected to operate the oscillator in a range from about 500–2,000 Hz but preferably at about 1,000 Hz.

The drive circuit 16 comprises a voltage increasing circuit of resistor R5 and inductor L1, a switching circuit of resistor R7 and transistor Q1, a tone control circuit of capacitor C5 and resistor R6, and a filter capacitor C2. In the voltage increasing circuit, resistor R5 functions to limit current and inductor L1 functions to approximately double the voltage available to the piezoelectric transducer 18 when transistor Q1 switches "off". The switching circuit of resistor R7 and transistor Q1 receives a pulse from the timer's U1 pin 3 to turn transistor Q1 "on" and "off" which inversely turns the piezoelectric transducer 18 "on" and "off". Resistor R7 in the switching circuit limits current flow through the base of transistor Q1.

The tone control circuit of capacitor C5 and resistor R6 modulates the drive signal provided to the piezoelectric transducer 18 to create a more realistic sounding chime. Capacitor C5 charges at a rate determined by the duty cycle of the pulse received through transistor Q1. Resistor R6 provides a current path when capacitor C5 is charging and limits current through transistor Q1 when capacitor C5 becomes fully charged. Filter capacitor C2 reduces transients that may be caused during operation of the piezoelectric transducer 18.

The piezoelectric transducer 18 has two drive elements and does not have a feedback element. The piezoelectric transducer 18 is a North American Capacitor Company part number 22-005060. It is available from North American Capacitor Company, 7545 Rockville Road, P.O. Box 1284, Indianapolis, Ind. 46206-1284, U.S.A. (317) 273-0090.

Operation

Referring to FIGS. 1–2, the piezoelectric audio chime 10 operates as follows. The piezoelectric audio chime 10 is typically initiated by applying AC power to the power supply 12 through closing a switch (not shown). The switch could be a mechanical, electronic, or optical, and the switch could be actuated by an operator, a mechanical device or some other type of control.

Figure 3A:
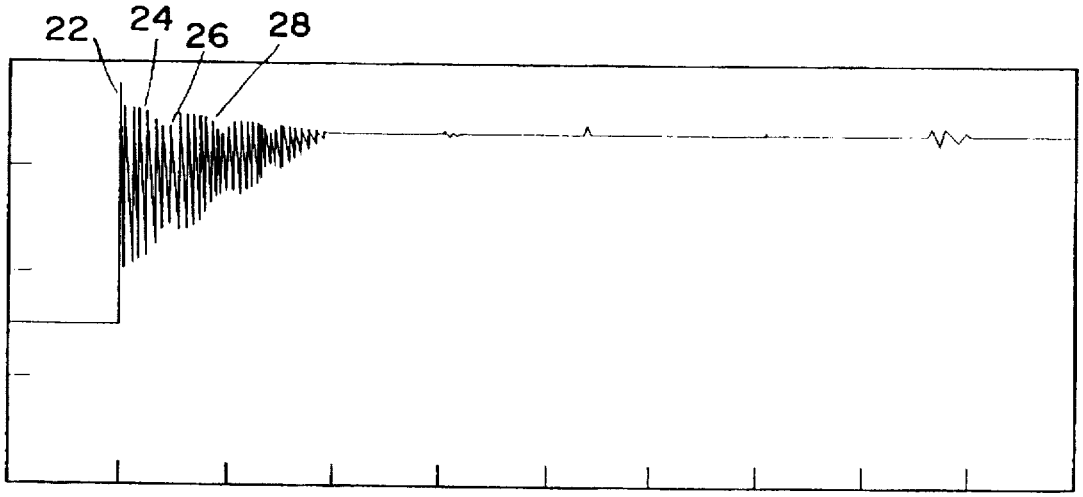
FIG. 3A shows a diagram of a signal seen by a piezoelectric transducer as measured at TP3.
Figure 3B:
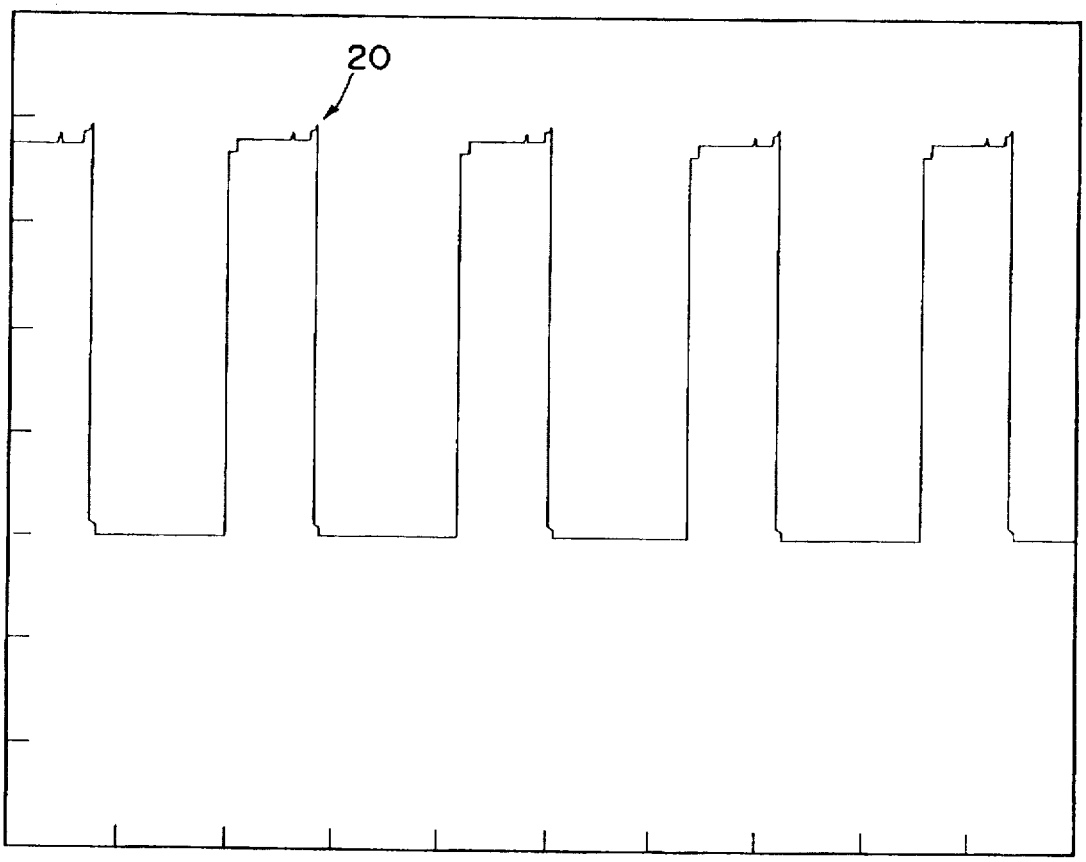
FIG. 3B shows a diagram of a signal produced by an oscillator measured at TP1.
Figure 4A:
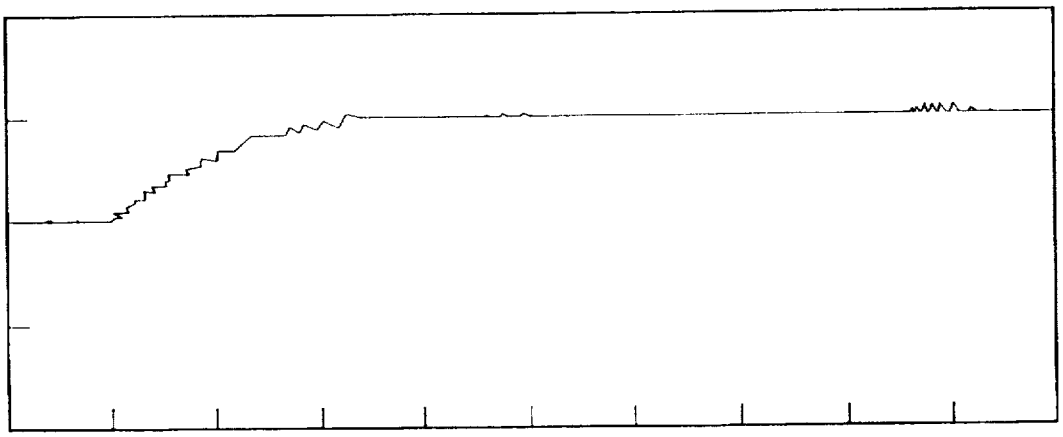
FIG. 4A shows a diagram of capacitor C5 charging measured at TP2.
Figure 4B:
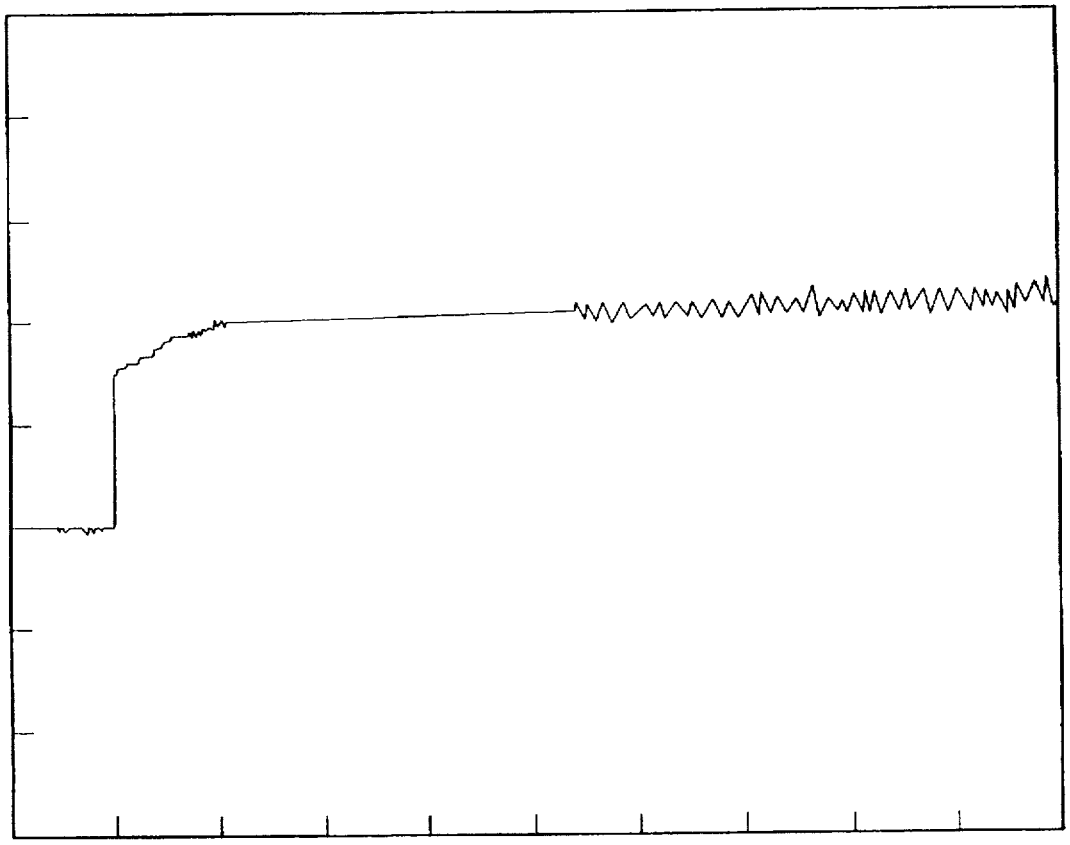
FIG. 4B shows a diagram of capacitor C2 charging measured at TP4.
Figure 5A:
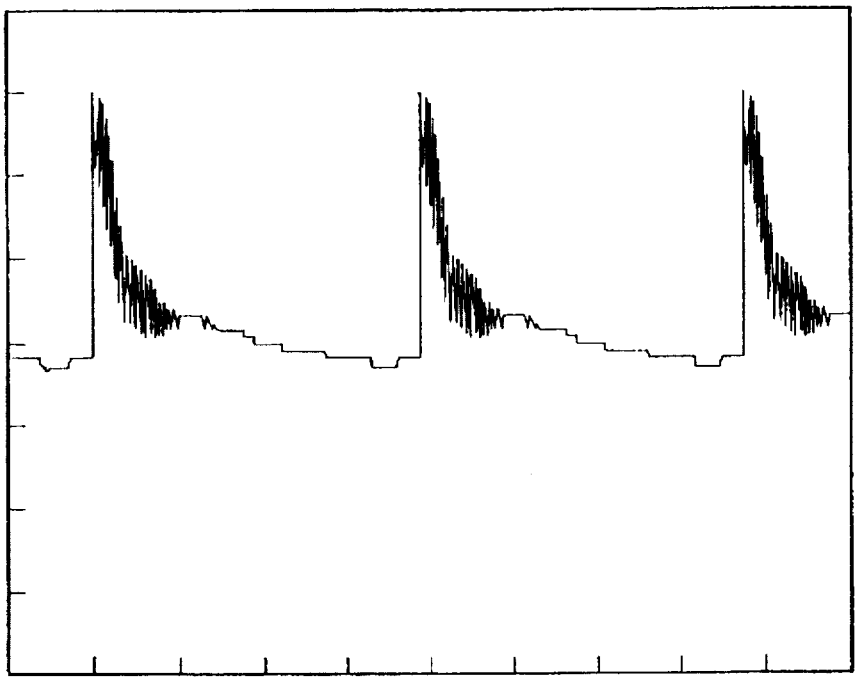
FIG. 5A PRIOR ART
FIG. 5A shows a prior art piezoelectric chime signal.
Figure 5B:
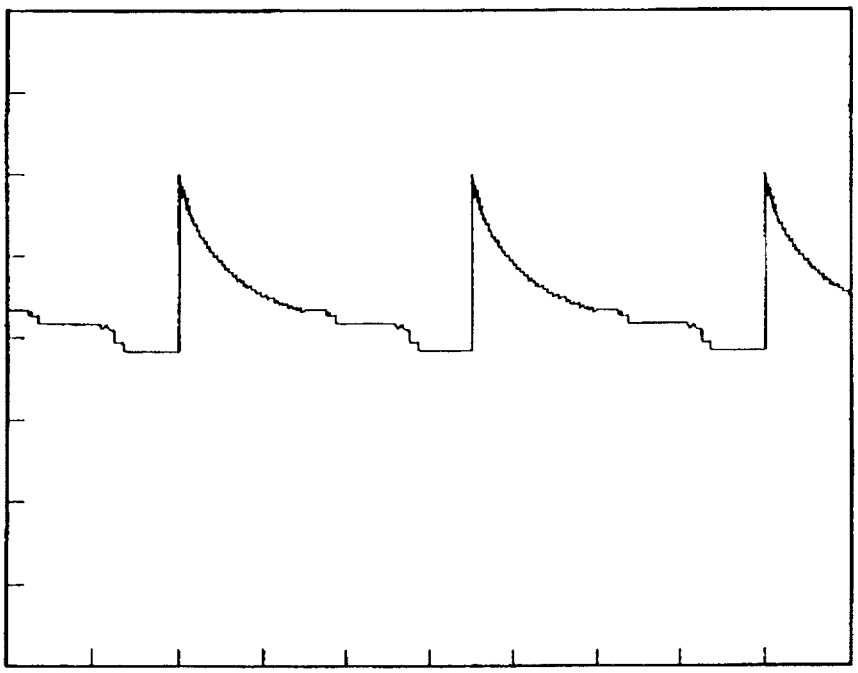
FIG. 5B PRIOR ART
FIG. 5B shows a prior art capacitor charging.
Figure 6:
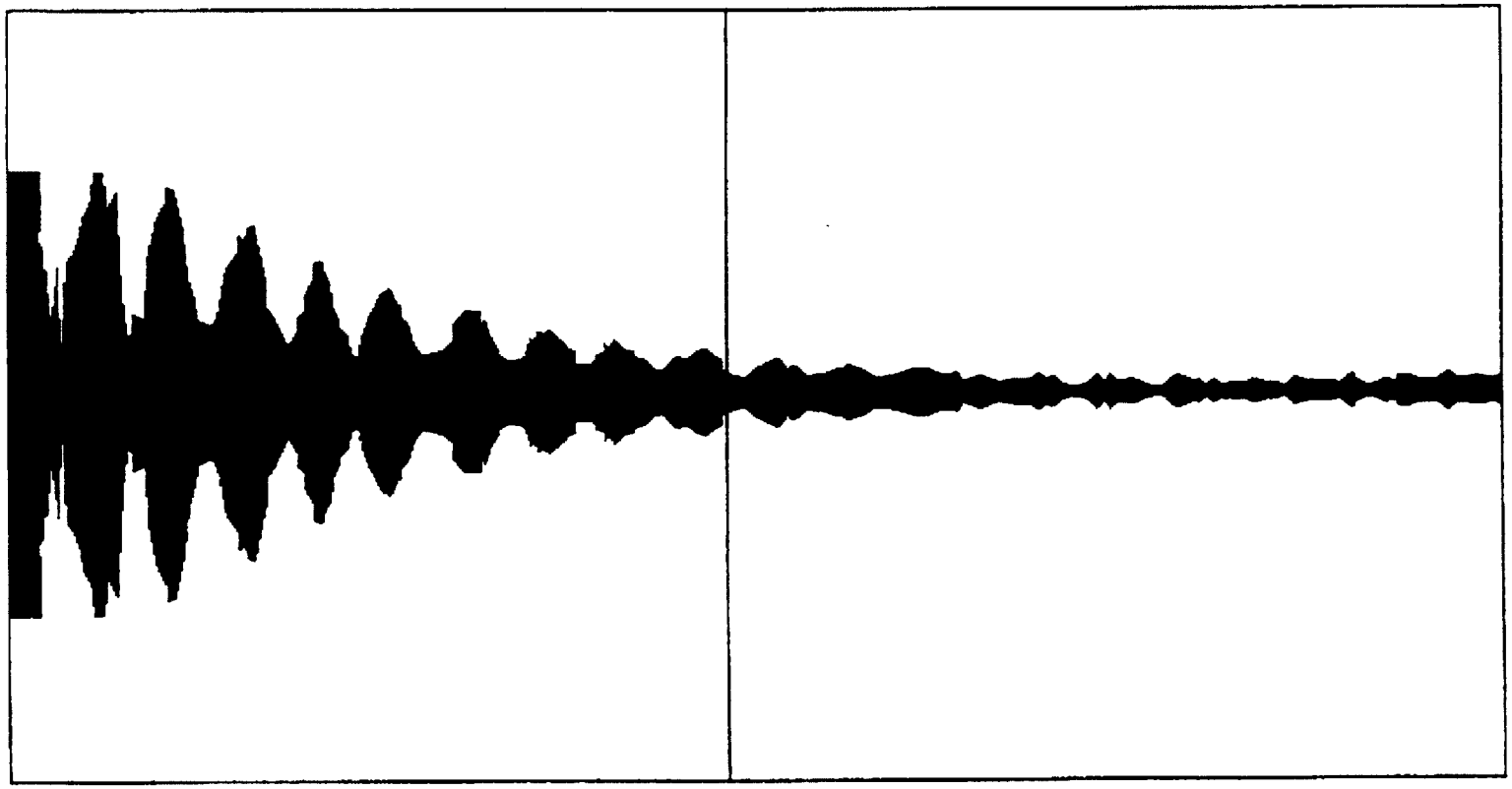
FIG. 6 PRIOR ART
FIG. 6 shows a prior art audio signal from a mechanical chime.

Referring to FIGS. 2 and 3B, upon application of power to the piezoelectric audio chime 10, the timer U1 begins to generate a substantially square wave 20 in an audio frequency range of about 500–2,000 Hz, preferably about 1,000 Hz with about a 35% duty cycle. This square wave 20 is applied to the base of transistor Q1 and when the square wave 20 goes high transistor Q1 turns "on" and when the square wave goes low transistor Ql turns "off".

When Q1 turns "on" for about 0.4–0.5 mS, Q1 shorts current flow around the piezoelectric transducer 18 to ground. Current inrushes into inductor L1 expanding its electromagnetic field and creating a voltage potential across inductor L1. The current inrush to inductor L1 is limited by resistor R5. Also current flow through transistor Q1 aides in charging capacitor C5.

When transistor Q1 turns "off" for about 0.7–0.9 mS, voltage is applied to the piezoelectric transducer 18 causing it to generate one cycle of the 1,000 Hz audio signal. Current flows through resistors R2, R6 and capacitor C5 to ground. This is the main current path for charging capacitor C5.

Referring to FIGS. 2–4B, as the number of cycles transistor Q1 turns "on" and "off" increases, the charge on capacitors C2 and C5 also increases. As capacitors C2 and C5 charge up, the power available to drive the piezoelectric transducer 18 proportionally decreases. As the power to drive the piezoelectric transducer 18 decreases, the amplitude of the audio output also proportionally decreases. When capacitors C2 and C5 become fully charged, the audio output of the piezoelectric transducer 18 ceases.

Referring to FIGS. 2 and 3A, transistor Q1 turns "on" and "off" components in the drive circuit 16 that operate to modulate the amplitude of the audio output signal. The chime is generated by beginning at a maximum amplitude 22, decreasing in amplitude 24 for a first period of time, increasing in amplitude 26 second period of time, and decreasing in amplitude 28 for a third period of time. This sequence of beginning at a maximum amplitude 22, decreasing in amplitude 24, increasing in amplitude 26, and decreasing in amplitude 28 repeats itself to create a ringing waveform. The first period of time, the second period of time, and the third period of time are in the range from 5–50 milliseconds. The piezoelectric audio chime 10 can be installed in an elevator to meet standards such as the Americans With Disabilities Act (ADA), *Accessibility Guidelines for Buildings and Facilities*, 4.10.13 *Car Position Indicators*, 56 Federal Register 144 (Jul. 26, 1991).

What is claimed is:

1. A piezoelectric audio chime, comprising:

(a) a D.C. power supply having a positive voltage source and a ground;

(b) an oscillator connected between the positive voltage source and the ground producing a first waveform that is substantially a square wave;

(c) a driver circuit that comprises, (1) a resistor connector to the oscillator receiving the first waveform, (2) a transistor with a base connected to the resistor receiving the first waveform, a collector connected to the positive voltage source, and an emitter, and, (3) a capacitor connected to the emitter of the transistor and to the ground, so that when the transistor turns "off" the capacitor discharges; and, (d) a piezoelectric audio transducer with a first lead connected to the transistor collector and a second lead connected to the emitter producing a chime that has an amplitude modulated ringing waveform.

2. The piezoelectric audio chime as in claim 1 wherein the chime is generated by a sequence of beginning at a maximum amplitude, decreasing in amplitude for a first period of time, increasing in amplitude second period of time, and decreasing in amplitude for a third period of time.

3. The piezoelectric audio chime as in claim 2 wherein the sequence repeats to create a ringing waveform.

4. The piezoelectric audio chime as in claim 2 wherein the first period of time, the second period of time, and the third period of time are in the range from 5–50 milliseconds.

5. The piezoelectric audio chime as in claim 1 wherein the chime has a duration in the range from 200–500 milliseconds.

6. The piezoelectric audio chime as in claim 1 wherein the first waveform is in the range from 500–2000 Hz.

7. The piezoelectric audio chime as in claim 1 further comprising a coil connected between the positive voltage source and the transistor collector to increase current flow during operation of the piezoelectric audio transducer.

8. The piezoelectric audio chime as in claim 1 wherein the oscillator is an integrated circuit.

9. The invention as in claim 8 wherein the integrated circuit is a 555 timer.

* * * * *